US011054761B2

(12) United States Patent
Shen et al.

(10) Patent No.: US 11,054,761 B2
(45) Date of Patent: Jul. 6, 2021

(54) IMAGE FORMING APPARATUS AND METHOD OF CONTROLLING THE SAME

(71) Applicant: Konica Minolta Inc., Tokyo (JP)

(72) Inventors: Yan Shen, Aichi (JP); Hideo Yamaki, Tokyo (JP); Futoshi Okazaki, Aichi (JP); Yasuyuki Inada, Aichi (JP); Takahiro Kuroda, Aichi (JP); Yu Mukobayashi, Aichi (JP); Yoshitaka Nomura, Aichi (JP); Motoki Nakano, Aichi (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/844,843

(22) Filed: Apr. 9, 2020

(65) Prior Publication Data

US 2020/0333728 A1 Oct. 22, 2020

(30) Foreign Application Priority Data

Apr. 22, 2019 (JP) ..... JP2019-080789

(51) Int. Cl.
*G03G 15/08* (2006.01)
*G03G 15/00* (2006.01)

(52) U.S. Cl.
CPC ..... *G03G 15/0856* (2013.01); *G03G 15/5033* (2013.01)

(58) Field of Classification Search
CPC ..... G03G 21/0005; G03G 21/0011
See application file for complete search history.

(56) References Cited

U.S. PATENT DOCUMENTS

2007/0201897 A1* 8/2007 Maeda ..... G03G 15/161 399/101
2016/0085195 A1* 3/2016 Uchida ..... G03G 15/5095 399/45
2016/0124364 A1* 5/2016 Tsukamura ..... G03G 15/5054 399/49
2016/0187815 A1* 6/2016 Funatani ..... G03G 15/161 399/72
2017/0123358 A1* 5/2017 Sato ..... G03G 15/5058

FOREIGN PATENT DOCUMENTS

JP 2007-047553 A 2/2007
JP 2011-007831 A 1/2011

* cited by examiner

*Primary Examiner* — Carla H Therrien
(74) *Attorney, Agent, or Firm* — Squire Patton Boggs (US) LLP

(57) ABSTRACT

An image forming apparatus includes: a job acquirer that acquires a print job; a photoconductor including a surface on which a toner image is to be formed; an electrifying member that electrifies the photoconductor; an exposure member that exposes the photoconductor; a developing member that supplies toner to the photoconductor; a cleaner that cleans the photoconductor; and a controller connected to the job acquirer to control the image forming apparatus, wherein the controller computes a first non-toner region that is provided on the surface of the photoconductor when the toner image is formed on the photoconductor, the first non-toner region not containing toner in a longitudinal direction of the surface of the photoconductor, and the controller causes the exposure member and the developing member to form the toner image on the photoconductor and to form a set of toner patches in the first non-toner region.

18 Claims, 8 Drawing Sheets

IMAGE FORMING APPARATUS AND METHOD OF CONTROLLING THE SAME

The entire disclosure of Japanese patent Application No. 2019-080789, filed on Apr. 22, 2019, is incorporated herein by reference in its entirety.

BACKGROUND

Technological Field

The present disclosure relates to an image forming apparatus, and more specifically to toner patch forming control.

Description of the Related Art

Image forming apparatuses such as multi-functional peripherals (MFPs) often develop images with toner. In an image forming apparatus, typically, toner is primarily transferred to a photoconductor and then secondarily transferred to a transfer belt or sheet.

A lubricant is added as an external additive to the toner in order to reduce the friction between the cleaning blade and the photoconductor and to improve the toner releasability of the surface of the photoconductor. The toner and external additives remaining on the photoconductor after the secondary transfer are removed by the cleaning blade.

The image forming apparatus forms a set of toner patches on the surface of the photoconductor for cleaning the photoconductor. The toner supplied to the photoconductor by the toner patches stays between the photoconductor and the cleaning blade to form a static layer. The formation of the static layer enables the cleaning blade to effectively remove the toner and external additives on the photoconductor.

Too little toner for forming a static layer between the photoconductor and the cleaning blade prevents the formation of a sufficient static layer between the photoconductor and the cleaning blade, and the toner on the surface of the photoconductor may remain without being removed. The toner remaining on the photoconductor surface may cause image noise.

In contrast, too much toner for forming a static layer between the photoconductor and the cleaning blade causes adherence of excess lubricant to the surface of the photoconductor, which may cause image noise. Therefore, the image forming apparatus needs to form a set of toner patches on the photoconductor such that the amount of toner for forming a static layer between the photoconductor and the cleaning blade is within an appropriate range.

Regarding the supply of toner to the photoconductor, for example, JP 2007-47553 A discloses an image forming apparatus that "forms, on the surface of the photoconductor, a toner deposition patch image having a partial image to be transferred to the intermediate transfer belt and a partial image to be left on the photoconductor" (see [Abstract of the Disclosure]).

In addition, JP 2011-07831 A discloses an image forming apparatus "including: a photosensitive drum on which a latent image is formed; a developing device which develops the latent image formed on the photosensitive drum with toner to which lubricant has been added and which has been electrified to have a negative polarity, to form a toner image; a transfer belt which abuts on the photosensitive drum and is electrified to have a reverse polarity to the toner, to transfer the toner image formed on the photosensitive drum; and a controller which forms the toner image based on a toner forcible discharging patch in a non-image region of the photosensitive drum, and switches the polarity of the transfer belt to the same polarity as the toner when the non-image region of the photosensitive drum abuts on the transfer belt" (see [Abstract of the Disclosure]).

According to the techniques disclosed in JP 2007-47553 A and JP 2011-07831 A, toner patches may not be formed during high-speed printing in some cases. Therefore, there is a need for a technique that enables the formation of toner patches even during high-speed printing.

SUMMARY

The present disclosure has been made in view of the above background, and an object thereof in one aspect is to provide a technique for forming a set of toner patches during high-speed printing.

To achieve the abovementioned object, according to an aspect of the present invention, an image forming apparatus reflecting one aspect of the present invention comprises: a job acquirer that acquires a print job; a photoconductor including a surface on which a toner image is to be formed; an electrifying member that electrifies the photoconductor; an exposure member that exposes the photoconductor; a developing member that supplies toner to the photoconductor; a cleaner that cleans the photoconductor; and a controller connected to the job acquirer to control the image forming apparatus, wherein based on the print job, the controller computes a first non-toner region that is provided on the surface of the photoconductor when the toner image is formed on the photoconductor, the first non-toner region not containing toner in a longitudinal direction of the surface of the photoconductor, and based on determining that a length of the first non-toner region in a rotation direction of the photoconductor is equal to or greater than a threshold value determined in advance, the controller causes the exposure member and the developing member to form the toner image on the photoconductor and to form a set of toner patches in the first non-toner region.

BRIEF DESCRIPTION OF THE DRAWINGS

The objects, advantages, aspects, and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the technical idea according to the present invention will be described with reference to the drawings. However, the scope of the invention is not limited to the disclosed embodiments. In the following description, identical parts are denoted by the same reference signs. Their names and functions are also the same. Therefore, the detailed description thereof is not repeated.

First, the configuration of an image forming apparatus 100 according to the present embodiment will be described. Hereinafter, the image forming apparatus 100 implemented as an MFP will be described as an example. The image forming apparatus 100 is, for example, a color image forming apparatus, but the technical idea according to the present embodiment is applicable not only to a color image forming apparatus but also to a monochrome image forming apparatus.

Figure 1:
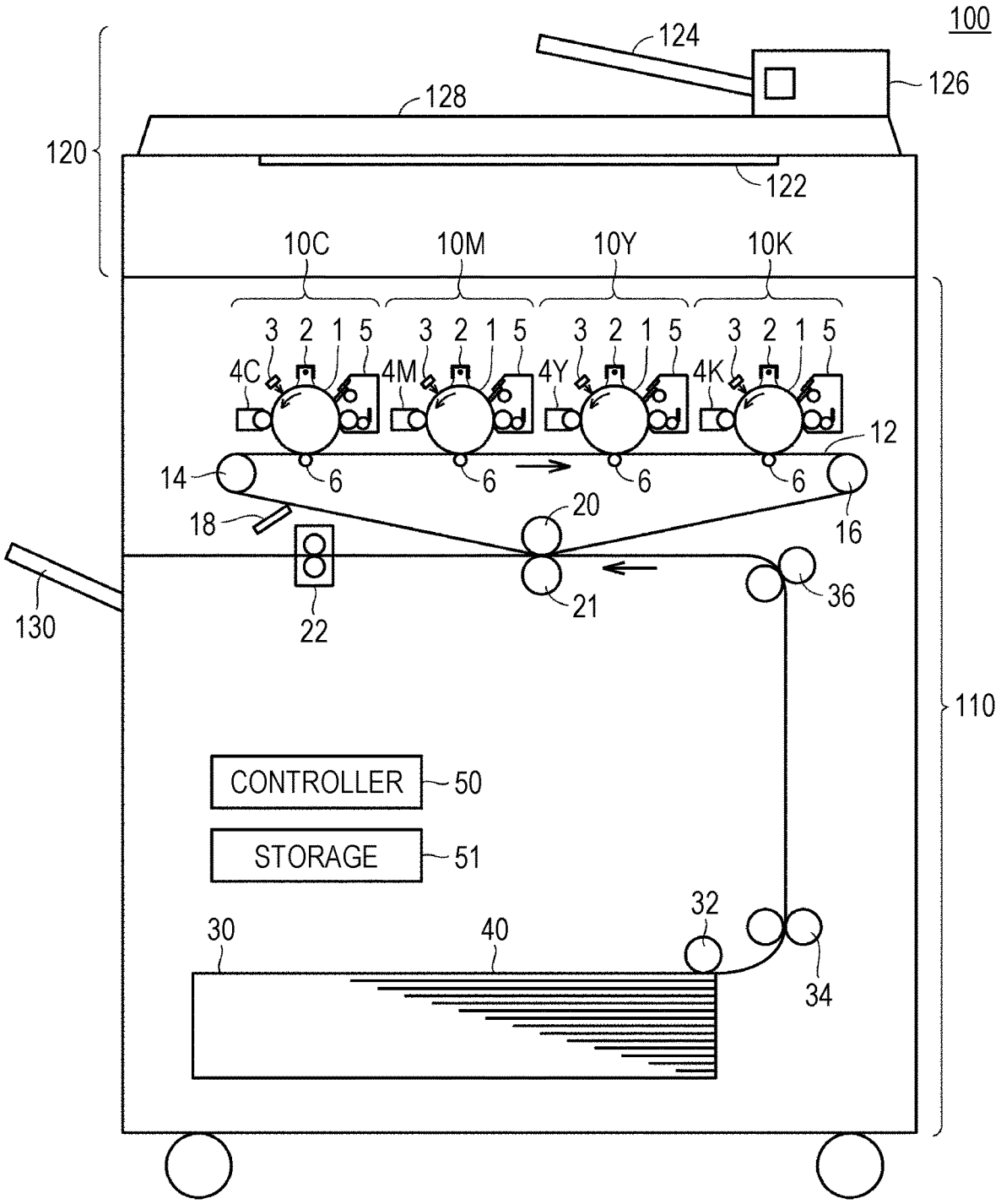
FIG. 1 is a diagram illustrating an exemplary configuration of an image forming apparatus according to an embodiment.

FIG. 1 is a diagram illustrating an exemplary configuration of the image forming apparatus 100 according to the present embodiment. Referring to FIG. 1, the image forming apparatus 100 includes a print engine 110, a document reader 120, and a discharge tray 130.

The print engine 110 includes imaging units 10C, 10M, 10Y, and 10K that generate toner images of cyan (C), magenta (M), yellow (Y), and key plate (K) (hereinafter also collectively referred to as the "imaging unit(s) 10"), an intermediate transfer belt 12, intermediate transferrer driving rollers 14 and 16, a belt cleaner 18, transfer rollers 20 and 21, a fixer 22, a sheet feeder 30, a delivery roller 32, transport rollers 34 and 36, a controller 50, and a storage 51. The imaging units 10 each include a photoconductor 1, an electrifying member 2, an exposure member 3, a developing member 4 (denoted by 4C, 4M, 4Y, or 4K in accordance with the color of toner images that the corresponding imaging unit 10 generates), a cleaner 5, and an intermediate transferrer contact roller 6. The document reader 120 includes an image scanner 122, a document feed table 124, an automatic document feeding device 126, and a document discharge table 128.

The print engine 110 performs printing on a medium 40 in the sheet feeder 30. The medium 40 is transported from the sheet feeder 30 by the delivery roller 32. The medium 40 is further transported to the transfer rollers 20 and 21 by the transport rollers 34 and 36. The transfer rollers 20 and 21 transfer toner images to the medium 40. Then, fixing is performed by the fixer 22, and the medium 40 is discharged to the discharge tray 130.

The imaging units 10 and the intermediate transfer belt 12 generate toner images to be transferred to the medium 40. The electrifying member 2 uniformly electrifies the surface of the photoconductor 1, which is an image carrier. The exposure member 3 forms an electrostatic latent image on the surface of the photoconductor 1 by exposing the surface of the photoconductor 1 according to a designated image pattern with laser writing or the like. The developing member 4 develops, as a toner image, the electrostatic latent image formed on the photoconductor 1.

The toner image formed on the surface of the photoconductor 1 is transferred to the intermediate transfer belt 12 by the intermediate transferrer contact roller 6. On the intermediate transfer belt 12, toner images are sequentially transferred from the respective photoconductors 1, and the four-color toner images are superimposed. The superimposed toner images are transferred from the intermediate transfer belt 12 to the medium 40 by the transfer rollers 20 and 21.

After the transfer of the toner image from the photoconductor 1 to the intermediate transfer belt 12, that is, after the secondary transfer, the cleaner 5 removes the toner and external additives remaining on the surface of the photoconductor 1 in order to clean the photoconductor 1. The cleaner 5 removes the toner and external additives on the surface of the photoconductor 1 using the static layer formed by the toner staying between the cleaner 5 and the photoconductor 1. The static layer not only cleans the surface of the photoconductor 1 but also reduces the friction between the cleaner 5 and the photoconductor 1 to protect the cleaner 5 and the photoconductor 1.

The document reader 120 reads a document and outputs the reading result as an input image to the print engine 110. The image scanner 122 scans a document placed on the platen glass. The automatic document feeding device 126 continuously feeds documents placed on the document feed table 124. Documents placed on the document feed table 124 are fed one by one by a delivery roller (not illustrated), and sequentially scanned by an image sensor placed in the image scanner 122 or in the automatic document feeding device 126. Scanned documents are discharged to the document discharge table 128.

The controller 50 controls the entire image forming apparatus 100. The storage 51 stores firmware and various settings of the image forming apparatus 100. The controller 50 refers to necessary data and programs from the storage 51.

Figure 2:
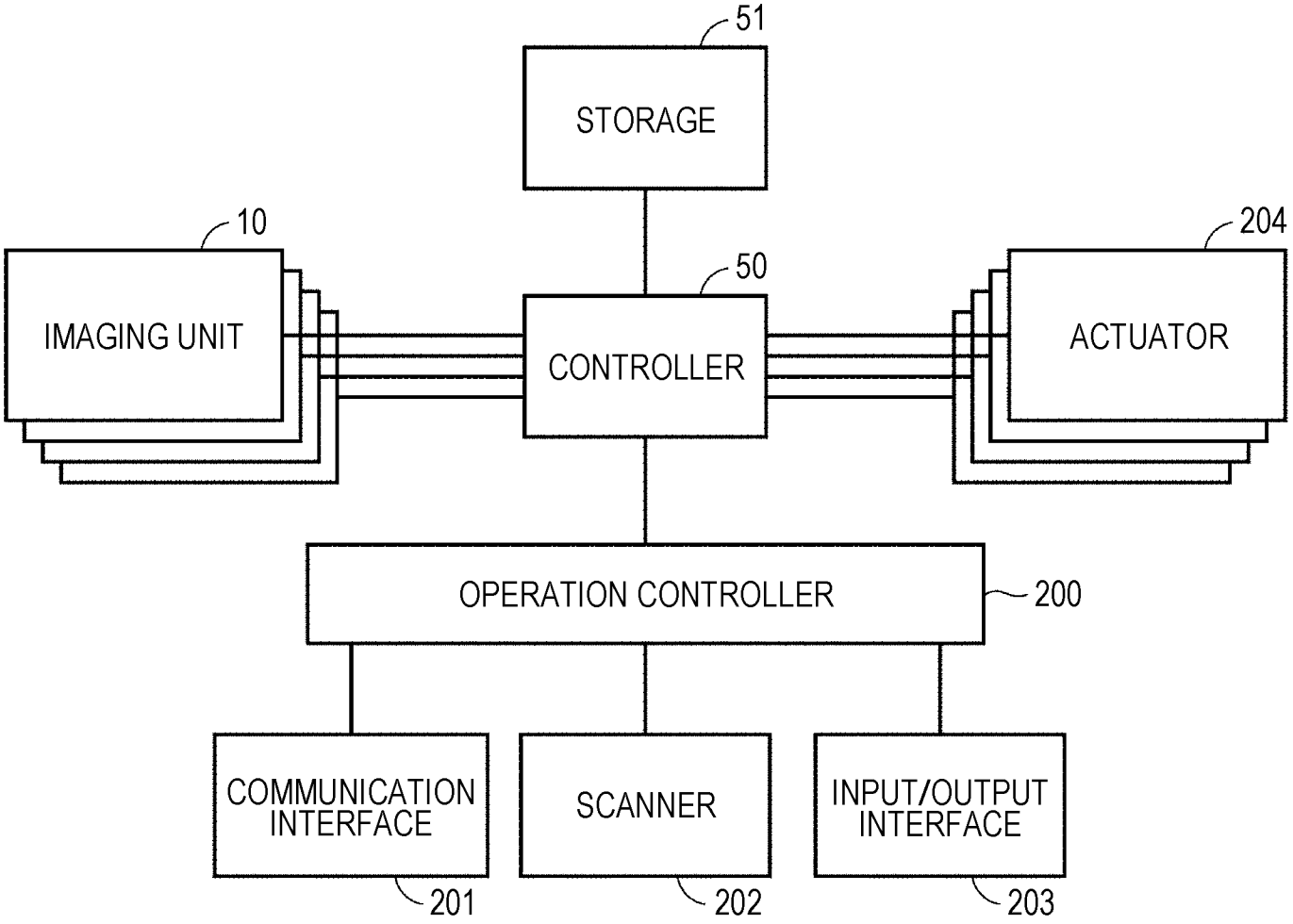
FIG. 2 is a diagram illustrating an exemplary circuit configuration of a part of the image forming apparatus.

FIG. 2 is a diagram illustrating an exemplary circuit configuration of a part of the image forming apparatus 100. In the example illustrated in FIG. 2, the controller 50 is connected to the storage 51, each imaging unit 10, a plurality of actuators 204, and an operation controller 200. The operation controller 200 is connected to a communication interface 201, a scanner 202, and an input/output interface 203.

The communication interface 201 receives an image or print job from a terminal such as an external computer, and transmits data to the terminal. The scanner 202 acquires image data from the document reader 120. The input/output interface 203 receives input from a touch panel or button (not illustrated) provided on the housing of the image forming apparatus 100, and displays information on a monitor (not illustrated) provided on the housing of the image forming apparatus 100.

The operation controller 200 transmits a print instruction to the controller 50 based on the image data or print job received from any of the communication interface 201, the scanner 202, and the input/output interface 203. The operation controller 200 also transmits a dot count, image data, and the like to the controller 50.

Based on the reception of the print instruction from the operation controller 200, the controller 50 prints the image data by controlling each of the actuators 204. The controller 50 may acquire necessary data and programs from the storage 51 or a memory built in the controller 50.

The actuators 204 may include various types of actuators such as, for example, motors for driving the imaging units 10 and various rollers, a halogen heater in the fixer 46, the electrifying member 2, the exposure member 3, and the developing member 4.

Figure 3:
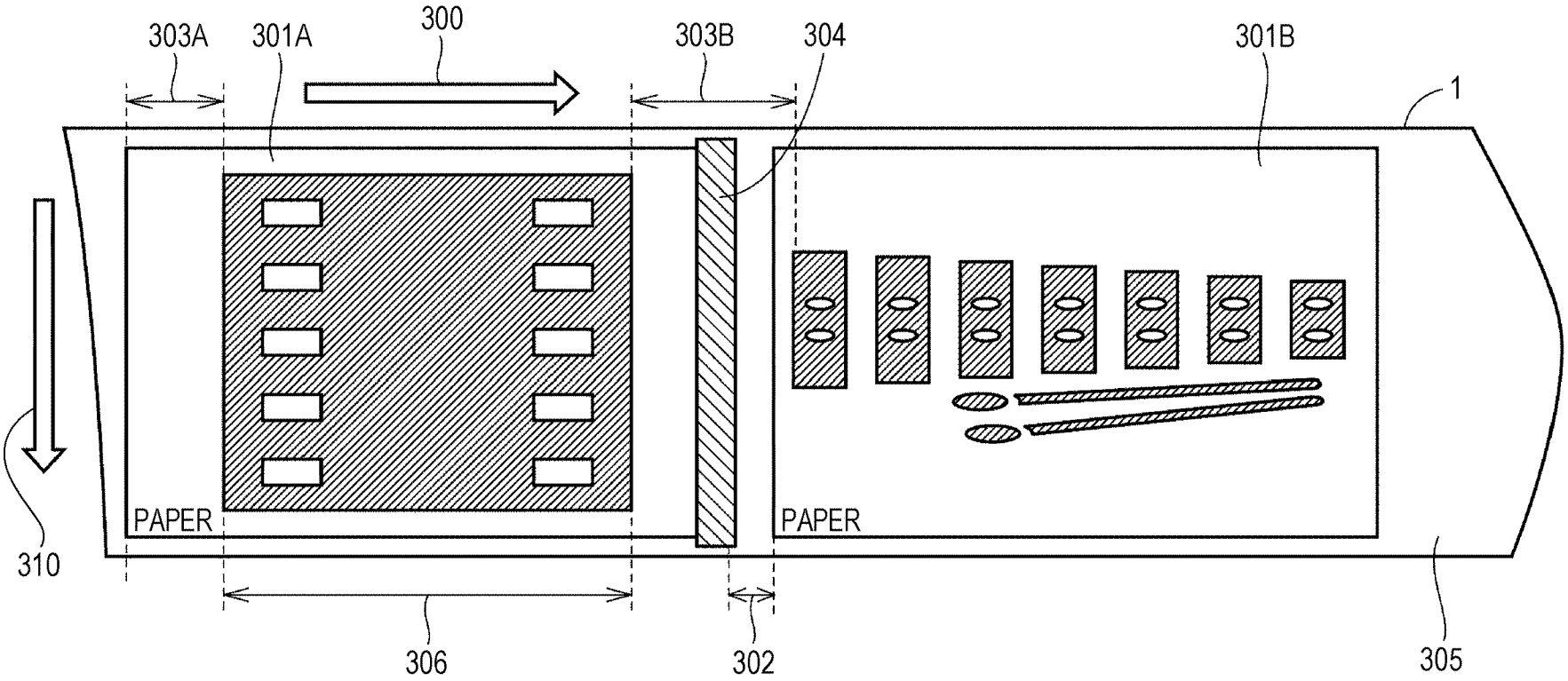
FIG. 3 is a diagram illustrating a first example of a set of toner patches according to an embodiment.

FIG. 3 is a diagram illustrating a first example of a set of toner patches according to the present embodiment. With reference to FIG. 3, a toner patch forming process that is performed by the image forming apparatus 100 will be described in detail. In the example illustrated in FIG. 3, the surface of the photoconductor 1 is expressed as a flat surface. The arrow 300 indicates the rotation direction of the photoconductor 1. According to the direction of the arrow 300, both the toner image corresponding to the first image and the toner image corresponding to the second image are transferred on the surface of the photoconductor 1. Each of the first and second images is an image that is printed on one sheet.

Hereinafter, the region corresponding to an image scheduled to be printed on one sheet, such as the first and second images, is referred to as an "image region" for distinguishing regions. Regions other than "image regions", such as the region 305, are referred to as "non-image regions". The image region 301A corresponds to the first image, and the image region 301B corresponds to the second image.

The sheet gap region 302 is the region between the image regions 301A and 301B. Hereinafter, the region between two image regions is particularly referred to as a "sheet gap region". Conventional image forming apparatuses form toner patches typically in sheet gap regions. However, because high-speed image forming apparatuses have been developed in recent years, the size of sheet gap regions between print images tends to decrease. A large sheet gap region enables the image forming apparatus to form a set of toner patches on the photoconductors, but reduces the printing speed, which is problematic. In contrast, a small sheet gap region may prevent the image forming apparatus from forming a set of toner patches on the photoconductors.

To deal with the aforementioned problem, the image forming apparatus 100 according to the present embodiment forms a set of toner patches 304 even in a non-toner region containing no toner within each of the image regions 301A and 301B. Here, the non-toner region is, for example, the region 303A or the region 303B. Although the region 303A is included in the image region 301A, it can be seen that no toner image is actually formed in the region 303A in the normal direction (direction of the arrow 310) relative to the rotation direction of the photoconductor 1. Similarly, no toner image is formed in the region 303B in the normal direction (direction of the arrow 310) relative to the rotation direction of the photoconductor 1.

In the example illustrated in FIG. 3, for a clear understanding of the arrangement of images, the length of the photoconductor 1 in the rotation direction (direction of the arrow 300) is longer than the length of the photoconductor 1 in the normal direction to the rotation direction (direction of the arrow 310). Actually, however, the length of the photoconductor 1 in the normal direction to the rotation direction is longer than the length of the photoconductor 1 in the rotation direction. Therefore, it can be said that the normal direction relative to the rotation direction of the photoconductor 1 is the longitudinal direction of the photoconductor 1. Therefore, hereinafter, the normal direction relative to the rotation direction of the photoconductor 1 is referred to as the "longitudinal direction" of the photoconductor 1.

Hereinafter, for distinguishing regions, regions where no toner image is formed in the longitudinal direction of the photoconductor 1, such as the region 303A, are referred to as "non-toner regions", whereas regions where a toner image is formed in the longitudinal direction of the photoconductor 1, such as the region 306, are referred to as "toner regions".

The image forming apparatus 100 selects the region where the set of toner patches 304 is to be formed from the entire region including the sheet gap region 302 and the non-toner regions. For example, the image forming apparatus 100 forms the set of toner patches 304 in the region 303B. The set of toner patches 304 includes both the sheet gap region 302 and a non-image region of the image region 301A. In this manner, the image forming apparatus 100 selects the area where the set of toner patches 304 is to be formed from the entire region including the sheet gap region 302 and the non-toner regions, so that the set of toner patches 304 can be formed on the photoconductor 1 even when the sheet gap region 302 is not sufficiently secured during high-speed printing.

Next, operations of various types of hardware of the image forming apparatus 100 will be described using the example illustrated in FIG. 3. The operation controller 200 acquires the image data corresponding to the image regions 301A and 301B and a print job from any of the communication interface 201, the scanner 202, and the input/output interface 203. The operation controller 200 then transmits the image data corresponding to the image regions 301A and 301B to the controller 50.

The controller 50 determines whether a set of toner patches is necessary based on a past print history or the like. The controller 50 also analyzes the received image data corresponding to the image regions 301A and 301B, and determines which part of the surface of the photoconductor 1 is a toner region or a non-toner region. In this example, the non-toner regions are the regions 303A and 303B. Next, the controller 50 determines whether there is a region large enough to form a set of toner patches in the regions 303A and 303B and the sheet gap region 302. In response to determining that there is one or more regions large enough to form a set of toner patches, the controller 50 causes each of the actuators 204 that drive the exposure member 3, the developing member 4, and the like to form a set of toner patches in any of the regions large enough to form a set of toner patches.

Figure 4:
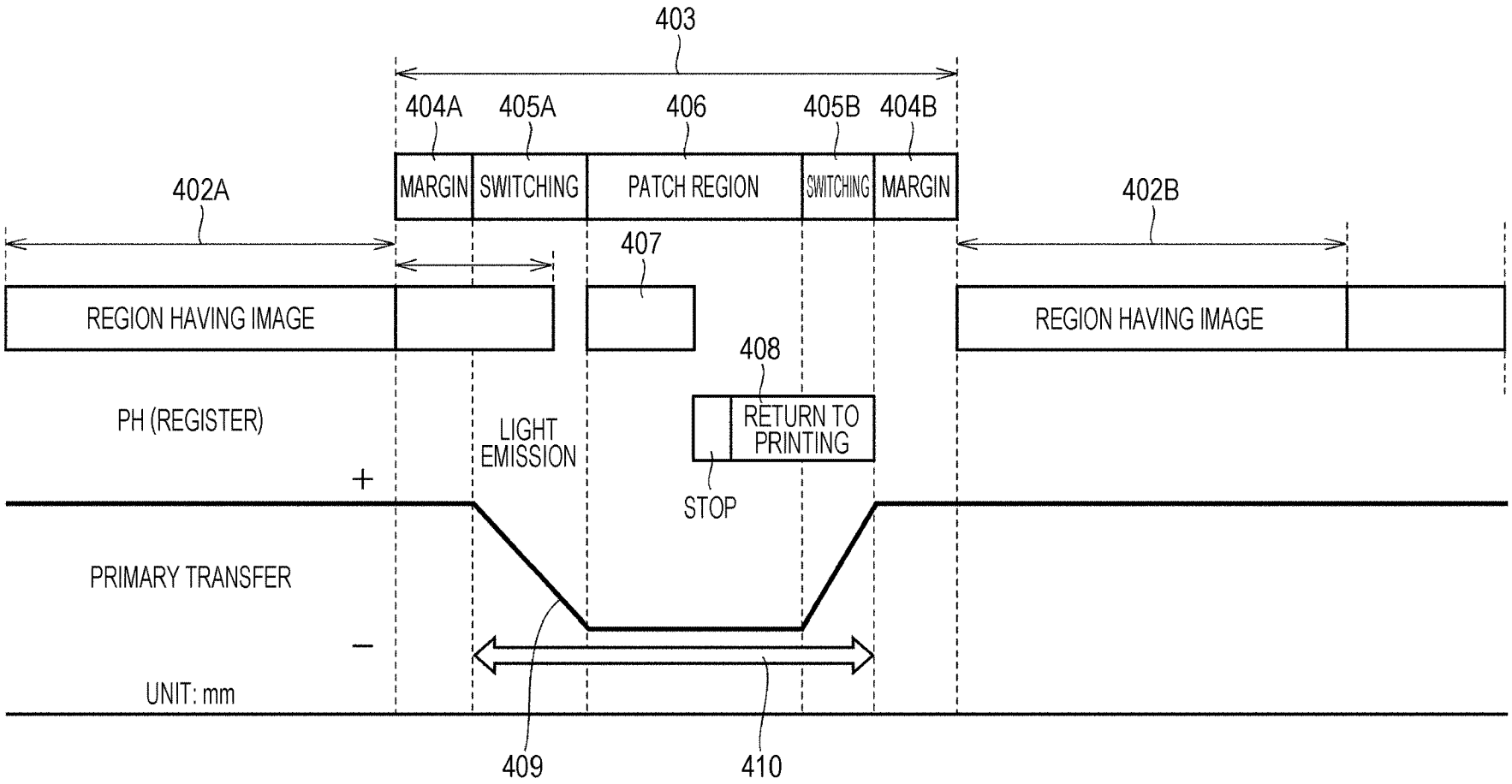
FIG. 4 is a diagram illustrating an example of a toner patch control sequence.

FIG. 4 is a diagram illustrating an example of a toner patch control sequence. With reference to FIG. 4, the procedure that the controller 50 follows to form a set of toner patches will be described. Suppose that the region 402A having an image, the region 403 having no image, and the region 402B having an image are continuously formed on the surface of the photoconductor 1. Then, suppose that a set of toner patches is formed in the region 403.

First, the controller 50 causes the actuators 204 to form the toner image in the region 402A. Next, the controller 50 provides a margin for forming no toner image in the region 404A. The region 404A is a safety margin for preventing the set of toner patches from overlapping with the toner image in the region 402A.

Next, in the region 405A, the controller 50 switches the polarity of the transfer bias of the exposure member 3 to the same polarity as the toner. After that, the controller 50 causes the actuators 204 to form the set of toner patches in the region 406. For example, the controller 50 causes the actuators 204 to form the set of toner patches in the region 407, and stops the toner patch forming process. Then, in the region 408, the controller 50 sets the image forming apparatus 100 back to normal printing mode. After forming the set of toner patches, in the region 405B, the controller 50 returns the transfer bias 409 of the exposure member 3 to the reverse polarity to the toner. Then, the controller 50 provides a margin for forming no toner image in the region 404B. The region 404B is a safety margin for preventing the set of toner patches from overlapping with the toner image in the region 402B. Finally, the controller 50 causes the actuators 204 to form the toner image in the region 402B.

Thus, in order to form a set of toner patches, the image forming apparatus 100 requires, with respect to the rotation direction of the photoconductor 1, at least a length of the threshold value 410 or more including the region 406 where the set of toner patches is formed and the regions 405A and 405B for switching the polarity of the exposure member 3.

Ideally, the threshold value 410 should also include the regions 404A and 404B as safety margins.

In a case where the photoconductor 1 has a non-toner region with a length of the threshold value 410 or more, the controller 50 causes the actuators 204 to form a set of toner patches on the photoconductor 1. However, in a case where the photoconductor 1 has only a non-toner region having a length less than the threshold value 410, the controller 50 does not cause the actuators 204 to form a set of toner patches on the photoconductor 1.

Figure 5:
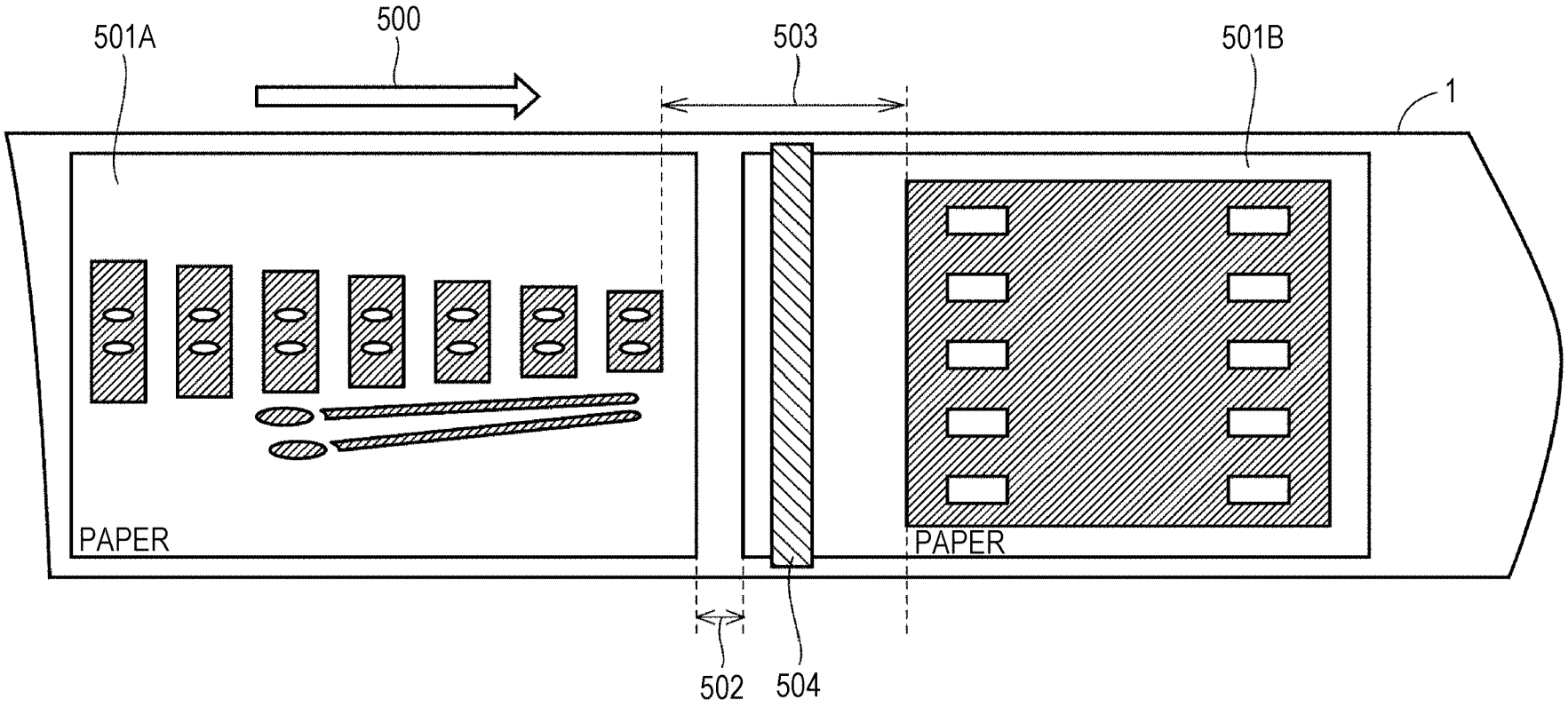
FIG. 5 is a diagram illustrating a second example of a set of toner patches according to an embodiment.

FIG. 5 is a diagram illustrating a second example of a set of toner patches according to the present embodiment. With reference to FIG. 5, another example of a toner patch forming process that is performed by the image forming apparatus 100 will be described. In the example illustrated in FIG. 5, the surface of the photoconductor 1 is expressed as a flat surface, as in FIG. 3. The arrow 500 indicates the rotation direction of the photoconductor 1. According to the direction of the arrow 500, the image region 501A and the image region 501B are provided on the surface of the photoconductor 1, and the sheet gap region 502 is provided between the image regions 501A and 501B.

Based on determining that the length of the non-toner region 503 is long enough to form a set of toner patches 504, the controller 50 causes the actuators 204 to form the toner patches 504 in the region 503. Unlike in the above example, the toner patches 504 are formed in the image region 501B in their entirety.

For example, if the controller 50 selects the region 503 as the region where the set of toner patches 504 is to be formed, the controller 50 may cause the actuators 204 to form the toner patches 504 in the middle of the region 503. Consequently, the controller 50 can cause the actuators 204 to form the set of toner patches 504 at a position that is most unlikely to affect the respective toner regions of the image regions 501A and 501B, regardless of the sheet gap region.

Figure 6:
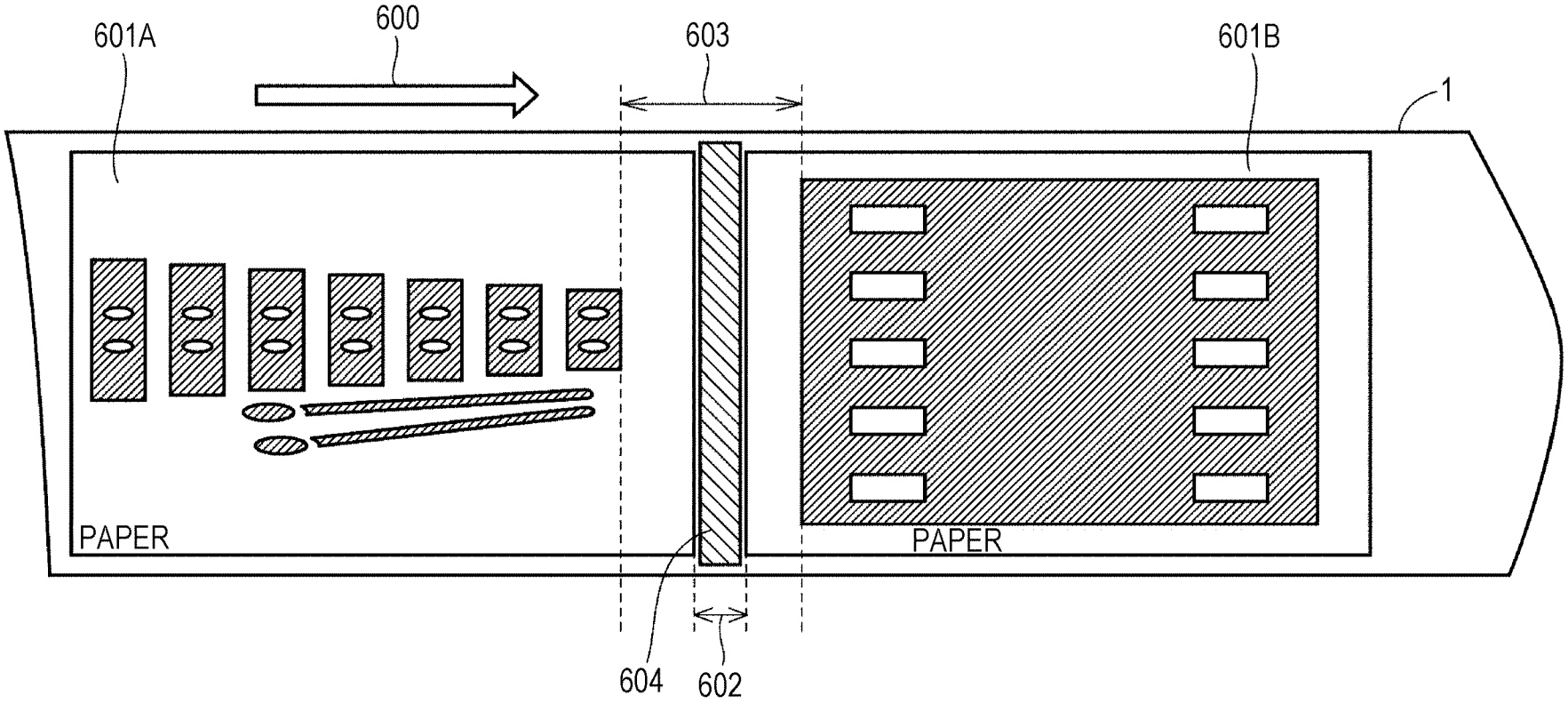
FIG. 6 is a diagram illustrating a third example of a set of toner patches according to an embodiment.

FIG. 6 is a diagram illustrating a third example of a set of toner patches according to the present embodiment. With reference to FIG. 6, another example of a toner patch forming process that is performed by the image forming apparatus 100 will be described. In the example illustrated in FIG. 6, the surface of the photoconductor 1 is expressed as a flat surface, as in FIG. 3. The arrow 600 indicates the rotation direction of the photoconductor 1. According to the direction of the arrow 600, the image region 601A and the image region 601B are provided on the surface of the photoconductor 1, and the sheet gap region 602 is provided between the image regions 601A and 601B.

Based on determining that the length of the non-toner region 603 is long enough to form a set of toner patches 604, the controller 50 causes the actuators 204 to form the toner patches 604 in the region 603. Unlike in the above examples, the toner patches 604 are formed in the sheet gap region 602. For example, in a case where the sheet gap region 602 is located in the middle of the region 603, the toner patches 604 can be formed in the sheet gap region 602.

In the conventional methods for forming toner patches, if the sheet gap region 602 is too short, the controller 50 cannot select the sheet gap region 602 as the region where the set of toner patches 604 is to be formed. However, in the image forming apparatus 100 according to the present embodiment, the controller 50 determines the position at which the set of toner patches 604 is to be formed based on the non-toner region 603, instead of the sheet gap region 602. Therefore, even when the sheet gap region 602 does not have a sufficient margin or a sufficient length for the process of switching the polarity of the exposure member 3, the controller 50 can use the non-toner regions at both ends of the sheet gap region 602 to form the set of toner patches 604. As a result, the controller 50 can effectively utilize the short sheet gap region 602.

Figure 7:
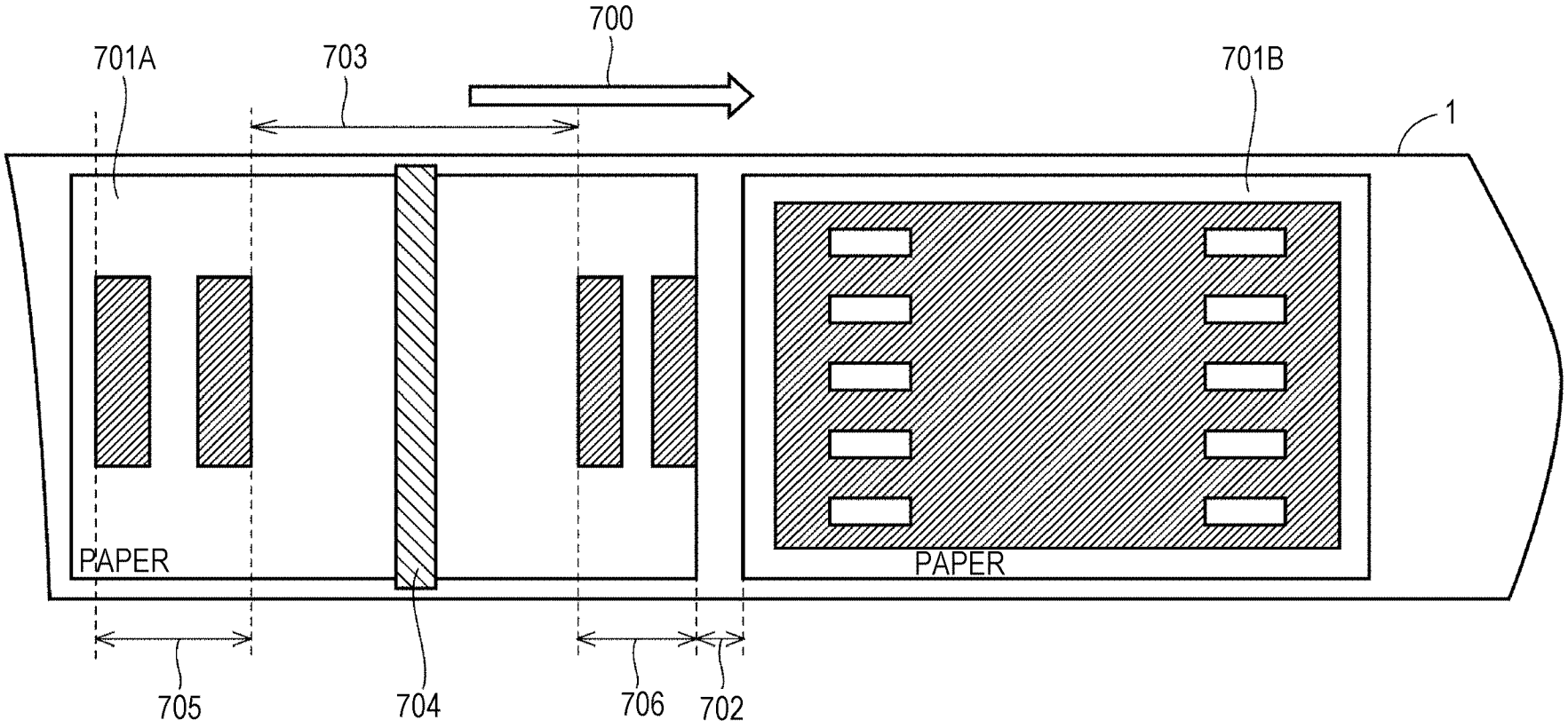
FIG. 7 is a diagram illustrating a fourth example of a set of toner patches according to an embodiment.

Toner patch formation is not limited to the above examples. Therefore, another example of a toner patch forming process that is performed by the image forming apparatus 100 will be described with reference to FIG. 7. FIG. 7 is a diagram illustrating a fourth example of a set of toner patches according to the present embodiment. In the example illustrated in FIG. 7, the surface of the photoconductor 1 is expressed as a flat surface, as in FIG. 3. The arrow 700 indicates the rotation direction of the photoconductor 1. According to the direction of the arrow 700, the image region 701A and the image region 701B are provided on the surface of the photoconductor 1, and the sheet gap region 702 is provided between the image regions 701A and 701B.

Based on determining that the length of the non-toner region 703 is long enough to form a set of toner patches 704, the controller 50 causes the actuators 204 to form the toner patches 704 in the region 703. Unlike in the above examples, the toner patches 704 are formed in the image region 701A. Further, it can be seen that the set of toner patches 704 is sandwiched between the toner region 705 and the toner region 706.

In this manner, the controller 50 effectively utilizes the region 703 sandwiched between the toner region 705 and the toner region 706, so that the controller 50 can cause the actuators 204 to form a set of toner patches on the surface of the photoconductor 1 even when the length of the sheet gap region 702 is insufficient.

Figure 8:
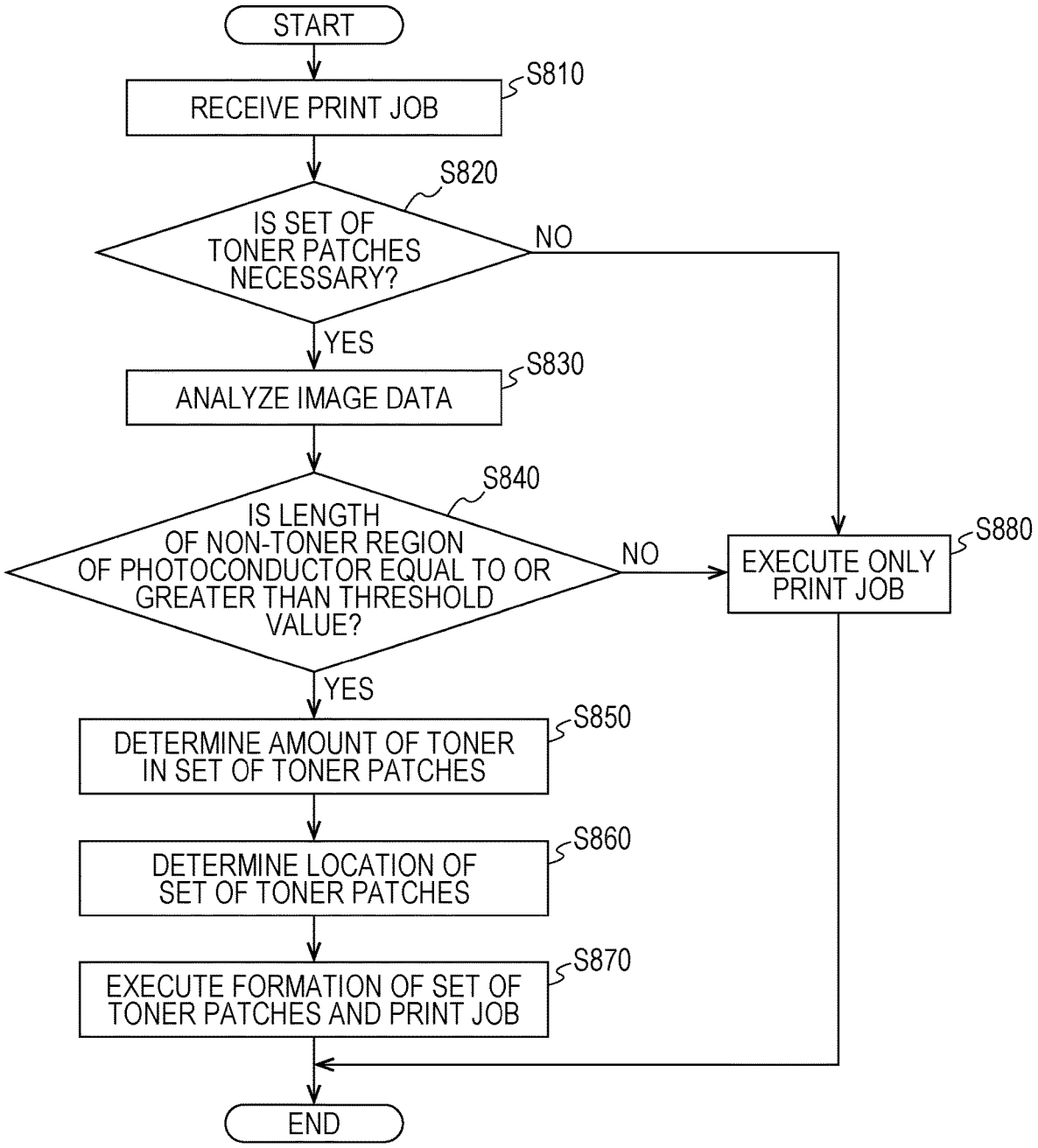
FIG. 8 is a flowchart illustrating an exemplary toner patch forming process that is performed by the image forming apparatus according to an embodiment.

Next, the control structure of the image forming apparatus 100 will be described with reference to FIG. 8. FIG. 8 is a flowchart illustrating an exemplary toner patch forming process that is performed by the image forming apparatus 100 according to the present embodiment. In one aspect, the controller 50 may read a program for performing the process in FIG. 8 from the storage 51 and execute the program.

In step S810, the operation controller 200 acquires image data and a print job from any of the communication interface 201, the scanner 202, and the input/output interface 203. The operation controller 200 also transmits the acquired image data and a print instruction for the image data to the controller 50.

In step S820, the controller 50 determines whether a set of toner patches is necessary based on a past print history or the like. In one aspect, the controller 50 may determine whether a set of toner patches is necessary based on the number of sheets to be printed, the amount of toner used, the operating time, the torque of each actuator 204, and a combination thereof. In response to determining that a set of toner patches is necessary (YES in step S820), the controller 50 shifts the control to step S830. Otherwise (NO in step S820), the controller 50 shifts the control to step S880.

In step S830, the controller 50 analyzes the image data received from the operation controller 200. Based on the image data, the controller 50 computes the positions of an image region, a toner region, and a non-toner region on the surface of the photoconductor 1.

In step S840, the controller 50 determines whether the length of the non-toner region in the rotation direction of the photoconductor 1 is equal to or greater than the threshold value 410. If a plurality of non-toner regions is on the photoconductor 1, the controller 50 determines whether the length of each of the non-toner regions in the rotation direction of the photoconductor 1 is equal to or greater than the threshold value 410.

In response to determining that the length of the non-toner region in the rotation direction of the photoconductor 1 is equal to or greater than the threshold value 410 (YES in step S840), the controller 50 shifts the control to step S850. Otherwise (NO in step S840), the controller 50 shifts the control to step S880.

In step S850, the controller 50 determines the amount of toner to be contained in the set of toner patches. In one aspect, when determining the amount of toner to be contained in the set of toner patches, the controller 50 may acquire a print history from the storage 51, and adjust the amount of toner to be contained in the set of toner patches based on the print history. In another aspect, the controller 50 may adjust the amount of toner to be contained in the set of toner patches based on the toner consumption of the developing member 4. Alternatively, the controller 50 may adjust the amount of toner to be contained in the set of toner patches based on a print history and the toner consumption of the developing member 4.

Further, the controller 50 may set the amount of toner to be contained in the set of toner patches within the range of a first amount of toner that at least enables a static layer of toner to be formed between the cleaner 5 and the photoconductor 1 to a second amount of toner that is highly likely to cause adherence of toner to the photoconductor 1. Because the first amount of toner and the second amount of toner vary depending on the type of the image forming apparatus 100, the first amount of toner and the second amount of toner may be stored in the storage 51 as model-specific settings.

In step S860, the controller 50 determines the position on the surface of the photoconductor 1 for forming the set of toner patches. In one aspect, the controller 50 may cause the actuators 204 to form the set of toner patches in the middle of the non-toner region. In another aspect, if there is a plurality of non-toner regions whose length in the rotation direction of the photoconductor 1 is equal to or greater than the threshold value, the controller 50 may select the longest non-toner region in the rotation direction of the photoconductor 1, and cause the actuators 204 to form the set of toner patches in the middle of the selected non-toner region.

In step S870, the controller 50 causes the actuators 204 to execute the formation of the set of toner patches and the print job. In one aspect, based on the amount of toner in the set of toner patches determined in step S850, the controller 50 may adjust the amount of toner in the set of toner patches by changing the density of toner patches to be formed on the photoconductor 1.

In another aspect, the controller 50 may adjust the amount of toner in the set of toner patches by changing the area of each toner patch to be formed on the photoconductor 1. In another aspect, the controller 50 may adjust the amount of toner in the set of toner patches by changing the exposure amount of the portion of the surface of the photoconductor 1 where the set of toner patches is to be formed. In another aspect, the controller 50 may adjust the amount of toner in the set of toner patches by changing the developing bias of the developing member 4. The controller 50 may adjust the amount of toner in the set of toner patches by combining these methods.

In step S880, because the length of the non-toner region is less than the threshold value 410, the controller 50 causes the actuators 204 to execute only the print job.

As described above, the image forming apparatus 100 selects the region for forming a set of toner patches from the entire region including not only the sheet gap region but also the non-toner region. Consequently, the image forming apparatus 100 can form a set of toner patches in the non-toner region to clean the photoconductor 1 even when the sheet gap region cannot be sufficiently secured during high-speed printing.

Although embodiments of the present invention have been described and illustrated in detail, the disclosed embodiments are made for purposes of illustration and example only and not limitation. The scope of the present invention should be interpreted by terms of the appended claims, and it is intended that all modifications within the meaning and scope equivalent to the scope of claims are included.

What is claimed is:

1. An image forming apparatus comprising:

a job acquirer that acquires a print job;

a photoconductor including a surface on which a toner image is to be formed;

an electrifying member that electrifies the photoconductor;

an exposure member that exposes the photoconductor;

a developing member that develops the toner image on the photoconductor;

a cleaner that cleans the photoconductor; and a controller connected to the job acquirer to control the image forming apparatus, wherein based on the print job, the controller computes a position of an image region on the surface of the photoconductor, the image region being defined as a region corresponding to an image scheduled to be printed on a sheet, the image region having a toner region and a non-toner region, the non-toner region being defined as a region that does not contain toner in the image region in a longitudinal direction of the surface of the photoconductor, and based on determining that a length of the non-toner region in a rotation direction of the photoconductor is equal to or greater than a threshold value, the controller causes the exposure member and the developing member to form the toner image on the photoconductor and to form a set of toner patches in the non-toner region.

2. The image forming apparatus according to claim 1, wherein the toner region includes a first toner region that contains toner in the longitudinal direction of the surface of the photoconductor and a second toner region that is different in position from the first toner region in the rotation direction of the photoconductor, the first toner region and the second toner region each form an image to be transferred to one sheet, and the non-toner region is located between the first toner region and the second toner region.

3. The image forming apparatus according to claim 1, wherein based on receiving a print job for a first image and a print job for a second image from the job acquirer, the controller computes a length of a second non-toner region in the rotation direction of the photoconductor, the second non-toner region being located, on the photoconductor, between a first toner image for forming the first image and a second toner image for forming the second image, and based on determining that the length of the second non-toner region in the rotation direction of the photoconductor is equal to or greater than the threshold value, the controller causes the exposure member and the developing member to form a set of toner patches in the second non-toner region.

4. The image forming apparatus according to claim 3, wherein the second non-toner region includes, on the photoconductor, at least a part of a region where the first image is formed or a part of a region where the second image is formed.

5. The image forming apparatus according to claim 1, further comprising a storage that stores a print history, wherein the controller acquires the print history from the storage, and adjusts an amount of toner in the set of toner patches based on the print history.

6. The image forming apparatus according to claim 1, wherein the controller sets an amount of toner to be contained in the set of toner patches within a range of a first limit amount to a second limit amount, the first limit amount is defined based on an amount of toner that enables a static layer of toner to be formed between the cleaner and the photoconductor, and the second limit amount is defined based on an amount of toner that causes adherence of toner to the photoconductor.

7. The image forming apparatus according to claim 1, wherein the controller adjusts an amount of toner to be contained in the set of toner patches based on a toner consumption of the developing member.

8. The image forming apparatus according to claim 1, wherein the controller changes a density of toner patches to be formed on the photoconductor to adjust an amount of toner in the set of toner patches.

9. The image forming apparatus according to claim 1, wherein the controller changes an area of each toner patch to be formed on the photoconductor to adjust an amount of toner in the set of toner patches.

10. The image forming apparatus according to claim 1, wherein the controller changes an exposure amount of a region of the photoconductor where the set of toner patches is to be formed to adjust an amount of toner in the set of toner patches.

11. The image forming apparatus according to claim 1, wherein the controller changes a developing bias of the developing member to adjust an amount of toner in the set of toner patches.

12. An image forming apparatus comprising:

a job acquirer that acquires a print job;

a photoconductor including a surface on which a toner image is to be formed;

an electrifying member that electrifies the photoconductor;

an exposure member that exposes the photoconductor;

a developing member that develops the toner image on the photoconductor;

a cleaner that cleans the photoconductor; and a controller connected to the job acquirer to control the image forming apparatus, wherein based on the print job, the controller computes a position of a first image region and a second image region, the first image region being separated from the second image region by a non-toner sheet gap region, the first and second image regions being defined as regions corresponding to an image scheduled to be printed on a sheet, the first image region having a first toner region and a first non-toner region and the second image region having a second toner region and a second non-toner region, the first and second non-toner regions being defined as regions that do not contain toner in the image regions in a longitudinal direction of the surface of the photoconductor, and based on determining that a length (i) of the first non-toner region of the first image region, (ii) of the second non-toner region of the second image region, or (iii) between the first and second toner regions of the image regions, in a rotation direction of the photoconductor is equal to or greater than a threshold value, the controller sets a position of a set of toner patches to be formed in one or more of the following regions large enough to accommodate the set of toner patches:

(i) at least one of first non-toner region of the first image region or the second non-toner region of the second image region, (ii) in the sheet gap, or (iii) in the sheet gap region and in at least one of the first or second non-toner regions.

13. A method comprising:

acquiring a print job;

based on the print job, computing a position of an image region on a surface of a photoconductor, the image region being defined as a region corresponding to an image scheduled to be printed on a sheet, the image region having a toner region and a non-toner, the non-toner region being defined as a region that does not contain toner in the image region in a longitudinal direction of the surface of the photoconductor; and based on determining that a length of the non-toner region in a rotation direction of the photoconductor is equal to or greater than a threshold value, forming the toner image on the photoconductor and forming a set of toner patches in the non-toner region.

14. The method according to claim 13, wherein the toner region includes a first toner region that contains toner in the longitudinal direction of the surface of the photoconductor and a second toner region that is different in position from the first toner region in the rotation direction of the photoconductor, the first toner region and the second toner region each form an image to be transferred to one sheet, and the non-toner region is located between the first toner region and the second toner region.

15. The method according to claim 13, further comprising:

based on receiving a print job for a first image and a print job for a second image, computing a length of a second non-toner region in the rotation direction of the photoconductor, the second non-toner region being located, on the photoconductor, between a first toner image for forming the first image and a second toner image for forming the second image; and based on determining that the length of the second non-toner region in the rotation direction of the photoconductor is equal to or greater than the threshold value, forming a set of toner patches in the second non-toner region.

16. The method according to claim 15, wherein the second non-toner region includes, on the photoconductor, at least a part of a region where the first image is formed or a part of a region where the second image is formed.

17. The method according to claim 13, further comprising adjusting an amount of toner in the set of toner patches based on a print history.

18. The method according to claim 13, further comprising setting an amount of toner to be contained in the set of toner patches within a range of a first limit amount to a second limit amount, wherein the first limit amount is defined based on an amount of toner that enables a static layer of toner to be formed between the cleaner and the photoconductor, and the second limit amount is defined based on an amount of toner that causes adherence of toner to the photoconductor.

* * * * *